US008760362B2

(12) United States Patent
Fuchs et al.

(10) Patent No.: US 8,760,362 B2
(45) Date of Patent: Jun. 24, 2014

(54) SINGLE-FEED MULTI-FREQUENCY MULTI-POLARIZATION ANTENNA

(75) Inventors: Andreas D. Fuchs, Lake Orion, MI (US); Elias H. Ghafari, Rochester Hills, MI (US)

(73) Assignee: Blaupunkt Antenna Systems USA, Inc., Rochester Hills, MI (US)

( * ) Notice: Subject to any disclaimer, the term of this patent is extended or adjusted under 35 U.S.C. 154(b) by 478 days.

(21) Appl. No.: 13/159,775

(22) Filed: Jun. 14, 2011

(65) Prior Publication Data

US 2012/0319924 A1 Dec. 20, 2012

(51) Int. Cl.
*H01Q 21/00* (2006.01)

(52) U.S. Cl.
USPC ..... 343/893

(58) Field of Classification Search
USPC ..... 343/893, 700 MS, 725, 853, 855
See application file for complete search history.

(56) References Cited

U.S. PATENT DOCUMENTS

| | | | | |
|---|---|---|---|---|
| 6,876,328 | B2 | 4/2005 | Adachi et al. | |
| 7,075,490 | B2 | 7/2006 | Noro | |
| 7,164,385 | B2 | 1/2007 | Duzdar et al. | |
| 7,227,500 | B2 * | 6/2007 | Oshima et al. | 343/700 MS |
| 7,253,770 | B2 | 8/2007 | Yegin et al. | |
| 7,405,700 | B2 | 7/2008 | Duzdar et al. | |
| 7,471,248 | B2 * | 12/2008 | Popugaev et al. | 343/700 MS |
| 7,548,207 | B1 | 6/2009 | Chu et al. | |
| 7,796,041 | B2 * | 9/2010 | Petropoulos | 340/572.7 |
| 7,994,999 | B2 | 8/2011 | Maeda et al. | |
| 8,174,455 | B2 | 5/2012 | Miyoshi et al. | |
| 2004/0183735 | A1 * | 9/2004 | Jecko et al. | 343/725 |
| 2009/0002229 | A1 | 1/2009 | Noro et al. | |

OTHER PUBLICATIONS

Office Action dated Apr. 11, 2014 in U.S. Appl. No. 13/288,467.

* cited by examiner

*Primary Examiner* — Seung Lee
(74) *Attorney, Agent, or Firm* — Warner Norcross & Judd LLP

(57) ABSTRACT

An antenna capable of receiving both left-hand circularly polarized (LHCP) signals and right-hand circularly polarized (RHCP) signals, and outputting both signals on a single feed. The antenna includes two coplanar concentric patches. The inner patch is substantially square. The outer patch surrounds the inner patch to define a gap therebetween. A resonant parallel inductive/LC circuit interconnects the two patches. The circuit includes a plurality of printed traces within the gap and interconnecting the concentric patches. The gap and each trace function as an LC circuit.

9 Claims, 6 Drawing Sheets

The SDARS LHCP zenith gain is 5dB and its cross-polarized (RHCP) gain is -8dB.

The GPS RHCP zenith gain is 4dB and its cross-polarized (LHCP) gain is -7dB.

The antenna input match is 2:1 for both SDARS and GPS

SINGLE-FEED MULTI-FREQUENCY MULTI-POLARIZATION ANTENNA

BACKGROUND OF THE INVENTION

The present invention relates to antennas and more particularly to single-feed multi-frequency multi-polarization antennas.

Antennas are in widespread use in automobiles, which typically include antennas for one or more of AM radio, FM radio, satellite radio, cellular phones, and GPS. These signals are of different frequencies and polarizations. For example, the signals associated with satellite radio (e.g. brand names XM® and Sirius®) are in the range of 2.320 to 2.345 GHz and are left-hand circularly polarized (LHCP); and the signals associated with global positioning systems (GPS) are in the range of 1.574 to 1.576 GHz and are right-hand circularly polarized (RHCP).

Antenna packages have been developed to receive and output multiple signals. At least one such package outputs the multiple signals on a single feed as disclosed in U.S. Pat. No. 7,164,385 issued Jan. 16, 2007 and U.S. Pat. No. 7,405,700 issued Jul. 29, 2008 both to Duzdar et al. As described in the patents, the disclosed antenna includes coplanar inner and outer patches. The outer patch surrounds the inner patch. The two patches are physically spaced from one another. A single feed is connected to the inner patch. The inner patch resonates at a first frequency with a first antenna polarization sense. The inner and outer patches together resonate at a second frequency with a second polarization sense. Both signals are outputted on the single feed.

Unfortunately, the prior art antenna has two shortcomings. First, the antenna is difficult to manufacture and to tune. While a consistent accurate gap between the antenna elements is important for the proper function of the antenna, current screening and printing processes do not provide the desired accuracy to produce antennas having a consistent accurate gap between the elements. Second, the two frequency bands cannot be tuned independently.

SUMMARY OF THE INVENTION

The aforementioned shortcomings are addressed by the antenna of the present invention, which is a single-feed multi-frequency multi-polarization antenna having inductive coupling between the inner and outer patches.

In the current embodiment, the antenna includes coplanar inner and outer patches. The outer patch surrounds the inner patch. The two patches are physically spaced from one another. A single feed is connected to the inner patch. The inner patch resonates at a first frequency with a first polarization sense. The inner and outer patches together resonate at a second frequency with a second polarization sense. The inner and outer patches are connected to each other by a plurality of relatively long, relatively thin traces. Each trace functions as an inductor. The individual traces or inductors are resonant and in parallel.

The inductors couple the outer patch signals to the outer patch and prevent the inner patch signals from coupling to the outer patch. The antenna of the present invention is relatively simple and inexpensive, and provides significantly enhanced manufacturability and performance over known antennas.

These and other advantages and features of the antenna will be more fully understood and appreciated by reference to the description of the current embodiment and the drawings.

DESCRIPTION OF THE CURRENT EMBODIMENT

Figure 1:
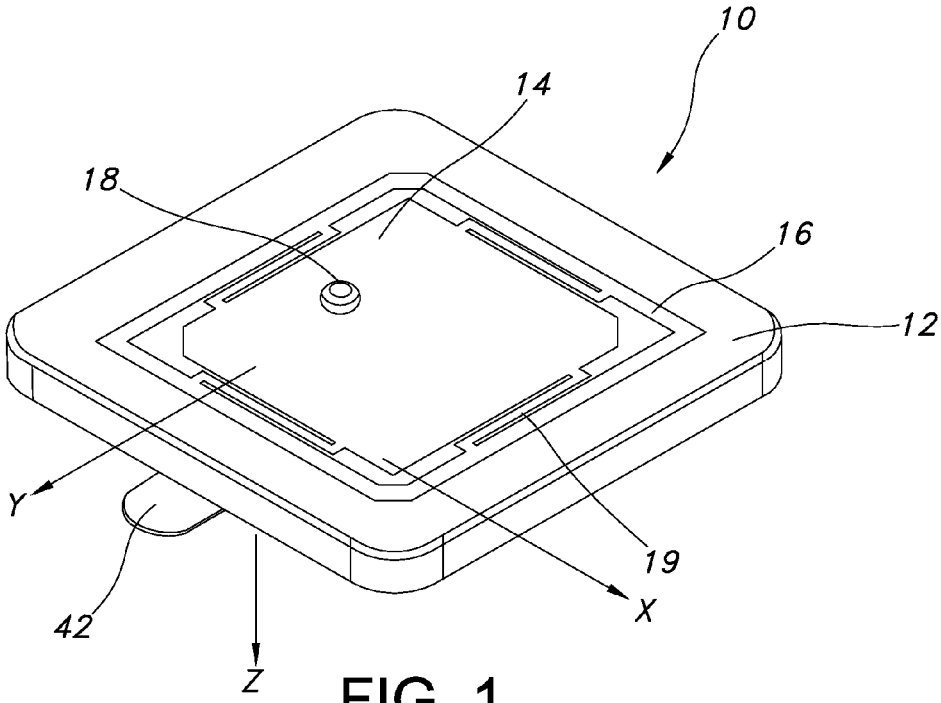
FIG. 1 is a perspective view of the antenna.
Figure 3:
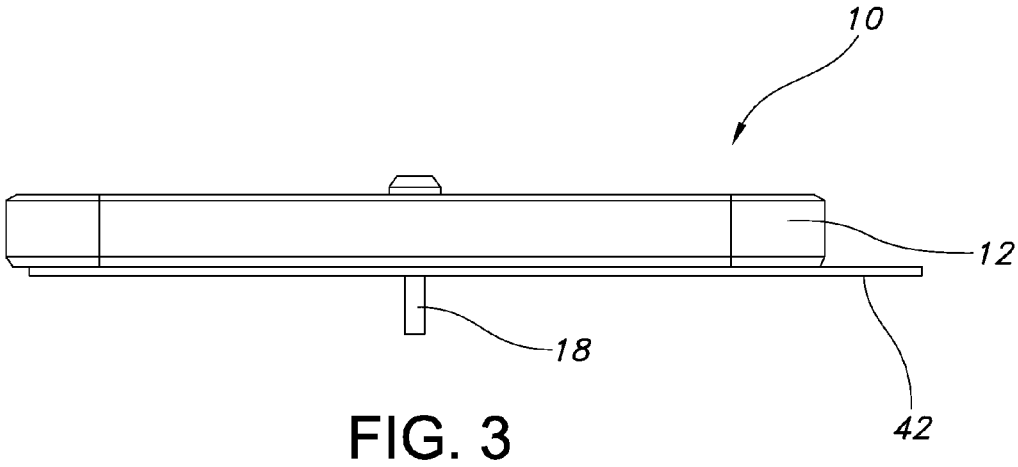
FIG. 3 is a side elevation view of the antenna.
Figure 2:
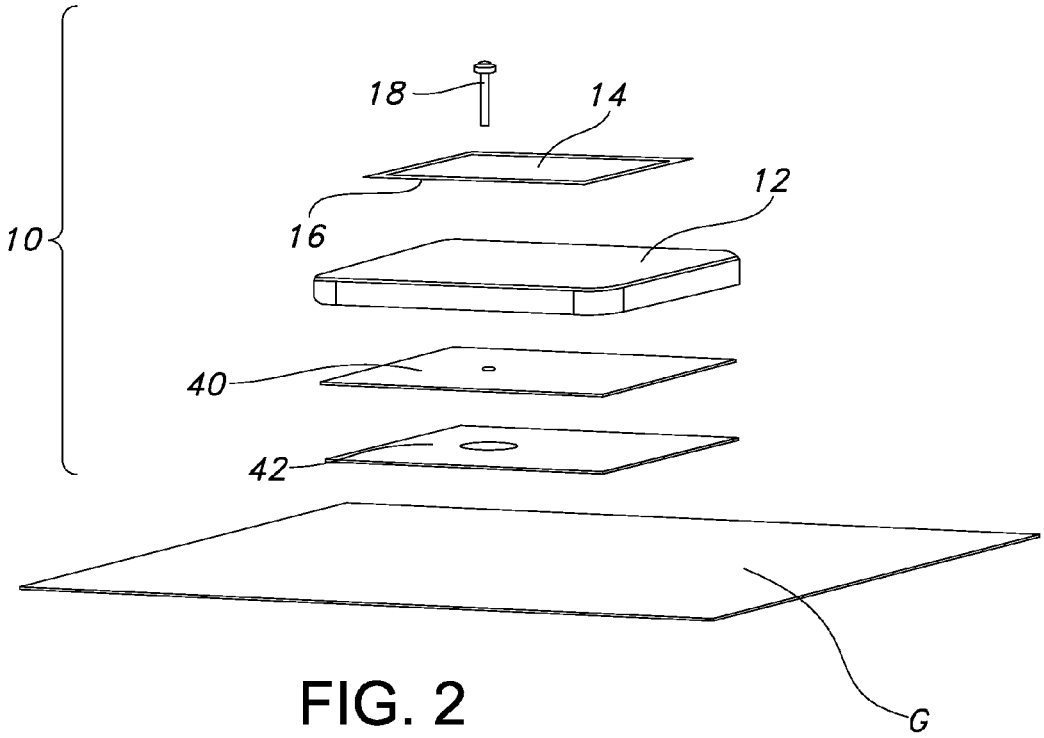
FIG. 2 is an exploded perspective view of the antenna but not including the adhesive release liner.

An antenna constructed in accordance with a current embodiment of the invention is illustrated in FIGS. 1-4 and generally designated 10. The antenna includes a substrate 12, an inner patch 14, an outer patch 16, a single feed or lead 18, and a plurality of traces 19 interconnecting the inner patch and the outer patch. The inner and outer patches 14 and 16 and the traces 19 are screened or printed on the substrate 12. The single feed 18 extends through the substrate 12 and is connected to the inner patch 14. The inner patch 14 receives a signal having a first frequency and a first polarization, and the inner and outer patches 14 and 16 together receive signals having a second frequency and a second polarization. The frequencies and polarizations are different. Both signals are outputted on the single feed 18.

The substrate 12 is well known to those skilled in the antenna art. The substrate can be fabricated of any suitable electrically nonconductive (i.e. dielectric) material such as plastic or ceramic. In the current embodiment, the material is a ceramic having a DK value in the range of 8 to 25. Alternatively, the material could be a PCB material having a DK value in the range of 1 to 15. Further alternatively, the material could be any suitable material. The substrate 12 supports the remaining elements of the antenna 10.

Figure 4:
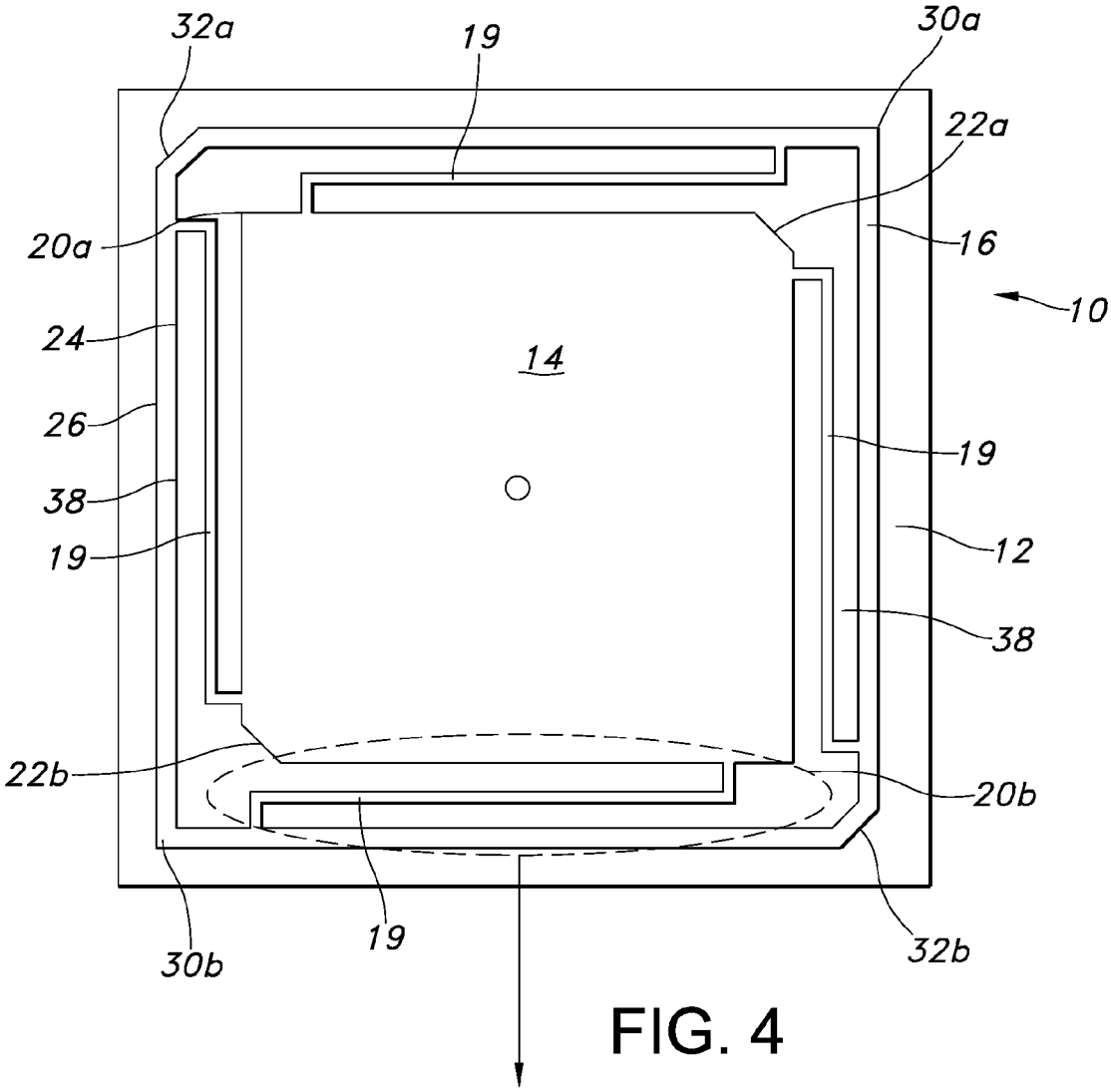
FIG. 4 is a top plan view of the antenna.

The inner patch 14 is substantially or generally square when viewed in plan view (see particularly FIG. 4). As a square, it has four corners 20*a*, 20*b*, 22*a*, and 22*b*. Two diagonally opposite corners 20*a* and 20*b* are substantially square, and the other two diagonally opposite corners 22*a* and 22*b* are substantially non-square as is conventional for antennas for circularly polarized signals. In the current embodiment, the corners 22*a* and 22*b* are cut at a 45° angle to the sides of the inner patch 14. Other appropriate techniques for non-squaring the corners 22*a* and 22*b* are and will be known to those skilled in the art.

The outer patch 16 surrounds the inner patch 14. The outer patch 16 has a substantially square inner edge 24 and a substantially square outer edge 26. The two edges 24 and 26 are substantially concentric. The inner edge 24 of the outer patch 16 is substantially square and includes four corners 30*a*, 30*b*, 32*a*, and 32*b*. In the current embodiment, the width of the patch 16 is general uniform throughout its circumference. Two diagonally opposite corners 30*a* and 30*b* are substantially square, and the other two diagonally opposite corners 32*a* and 32*b* are substantially not square. The square corners 30*a* and 30*b* are proximate or adjacent to the non-square corners 20*a* and 20*b* on the inner patch 14. And the non-square corners 32*a* and 32*b* are proximate or adjacent to the non-square corners 22*a* and 22*b* on the inner patch 14.

The inner edge 24 of the outer patch 16 is spaced from the inner patch. Therefore, the patches 14 and 16 define a gap 38 therebetween so that the patches 14 and 16 are physically separate from one another. The width of the gap is generally uniform about the perimeter of the inner patch 14. The gap widens in the areas of the corners 22*a*, 22*b*, 30*a*, and 30*b*.

Traces 19 extend between and interconnect the inner patch 14 and the outer patch 16. In the current embodiment, one trace is provided on each of the four sides of the inner patch 14. A larger or smaller number of traces can be provided. Each trace is relatively long and relatively thin. In the current embodiment, each trace is longer than one-half the length of the associated side of the inner patch 14, and is almost as long as the length of the side. The opposite ends of each trace 19 connect to the inner and outer patches 14 and 16. The remainder of each trace 19 is spaced from the inner and outer patches 14 and 16, and the width of each trace 19 is generally uniform throughout its length.

Figure 5:
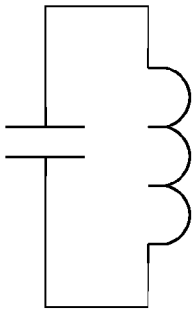
FIG. 5 is a schematic drawings illustrating the function of the gap and the traces.

The traces 19 function as inductors to inductively couple the outer patch 16 to the inner patch 14. Gap 40 functions as a capacitor, at least at some small level. Consequently, it is believed that the gap 40 and each trace 19 together function as a capacitor/inductor (LC) circuit as schematically illustrated in FIG. 5. And it is further believed that the gap 40 and the traces collectively function as a parallel resonant LC circuit coupling the outer patch signal (e.g. GPS) to the outer patch and to prevent the inner patch signal (e.g. SDARS) from coupling to the outer patch. Measurement of the capacitive function of the gap 40 and the inductive function of the traces 19 has proven difficult because any attempted measurement distorts the actual values.

The antenna 10 further includes a bottom metalized layer 40 on the lower surface of the substrate 12. A double-sided adhesive material 42 is applied to the bottom metallization 40. The adhesive material 42 may or may not be electrically conductive. A release liner 44 covers the underside of the adhesive material 42, and is removed when the antenna is to be attached to a supporting structure such as the illustrated ground plane G.

In the current embodiment, the patches 14 and 16, the traces 19, and the bottom layer 40 are silver or other suitable metal screened, printed, or otherwise formed directly on the substrate 12. The patches 14 and 16, the traces 19, and the bottom layer 40 are substantially planar. The patches 14 and 16 and the traces 19 are substantially coplanar. Currently, all of the elements are printed of the same material and thickness. Alternatively, the elements could be printed of different materials and/or thicknesses.

The relative sizes, shapes, and orientations of the patches 14 and 16 and the traces 19 can be tuned or otherwise modified to achieve desired performance. The patches 14 and 16 and the traces 19 shown in the drawings illustrate the current embodiment, which has been tuned to provide a balance among the performance factors. Those skilled in the art will recognize that the patches can be tuned differently to achieve different balances among the performance factors.

It is presently believed that the L and C values to be provided by the gap 40 and the traces 19 cannot be mathematically determined. The current embodiment was developed through trial and error, and simulations of the various designs.

The LC circuit provides a band stop filter (high impedance) for the inner patch (e.g. SDARS) frequencies and tends to make the outer patch (e.g. GPS) invisible to the inner patch. If the outer patch and the traces are removed, the inner patch functions almost unaffected. For the outer patch frequencies (e.g. GPS), the LC circuit presents a low impedance enabling the inner patch to connect to the outer patch—together creating a larger effective patch for the outer patch frequency range.

The formula used to determine the resonant frequency is:

$$f = \frac{\omega}{2\pi} = \frac{1}{2\pi\sqrt{LC}}.$$

Consequently, an infinite number of combinations of L and C will result in the same resonant frequency. The current embodiment is a tuned antenna for a dielectric constant (DK) of 9.5. If the DK is changed, the relative dimensions of the components also must change. The lower the DK of the substrate, the larger the patch and the traces must be. It is possible to replace the traces 19 with discrete L and C components soldered or otherwise connected between the inner and outer patches.

The single feed 18 is connected only to the inner patch 14. The feed 18 extends through the substrate 12. The feed 18 is connected off center of the inner patch 14 as is conventional for antennas for circularly polarized signals.

Operation

The antenna 10 outputs two different signals having different frequencies and different polarizations on the single feed 18. The inner patch 14 receives left-hand circularly polarized (LHCP) signals—for example those associated with satellite radio (SDARS). The patches 14 and 16 together receive right-hand circularly polarized (RHCP) signals—for example those associated with GPS signals.

In operation, the antenna 10 would be connected to an amplifier and a dual passband filter (not shown) both of any suitable design known to those skilled in the art. When the antenna 10 is for satellite radio signals and GPS signals, the two passbands are in the range of 2.320 to 2.345 GHz for the satellite radio signal, and in the range of 1.574 to 1.576 GHz for the GPS signal. The output of the amplifier and filter may be fed to a satellite radio receiver and/or a GPS unit.

Figure 6:
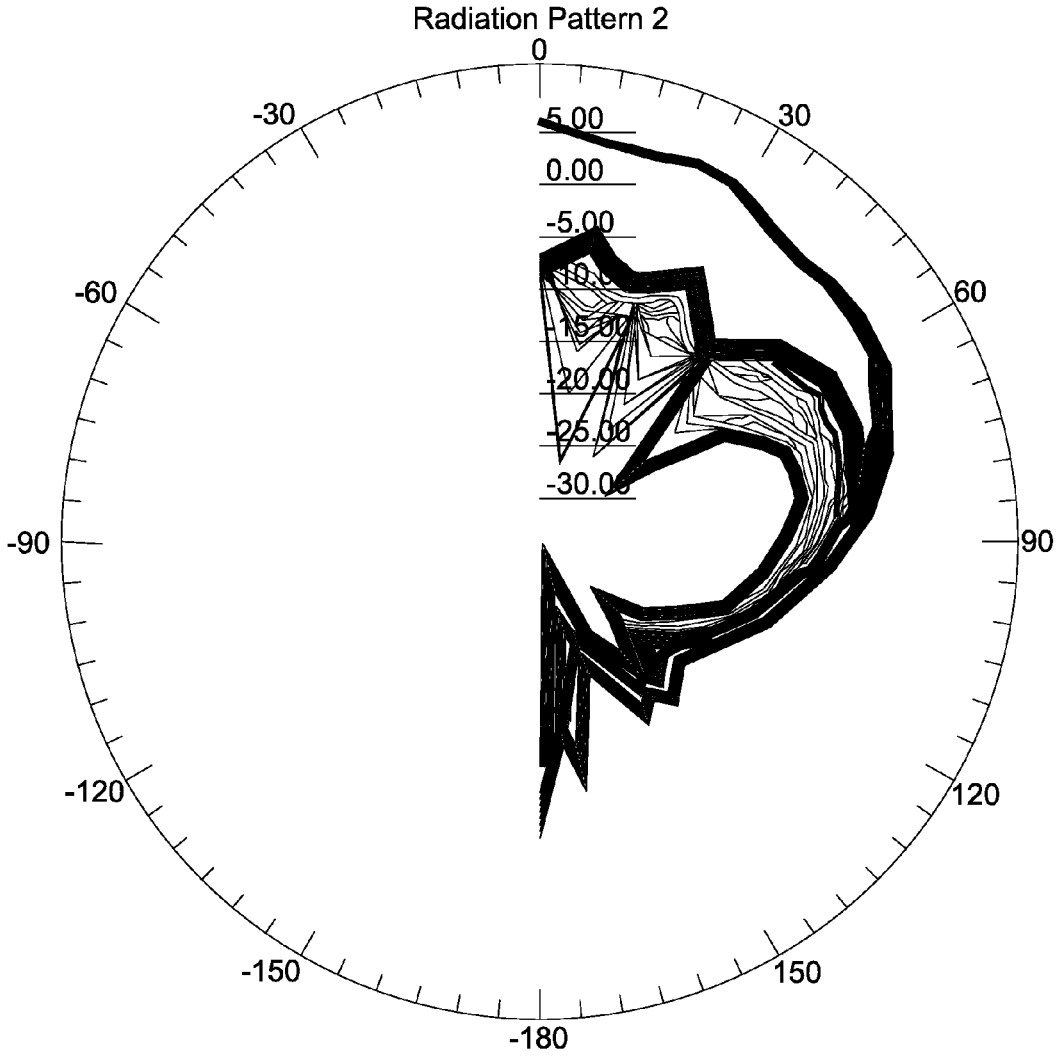
FIGS. 6-8 are plots illustrating the performance of the antenna.
Figure 7:
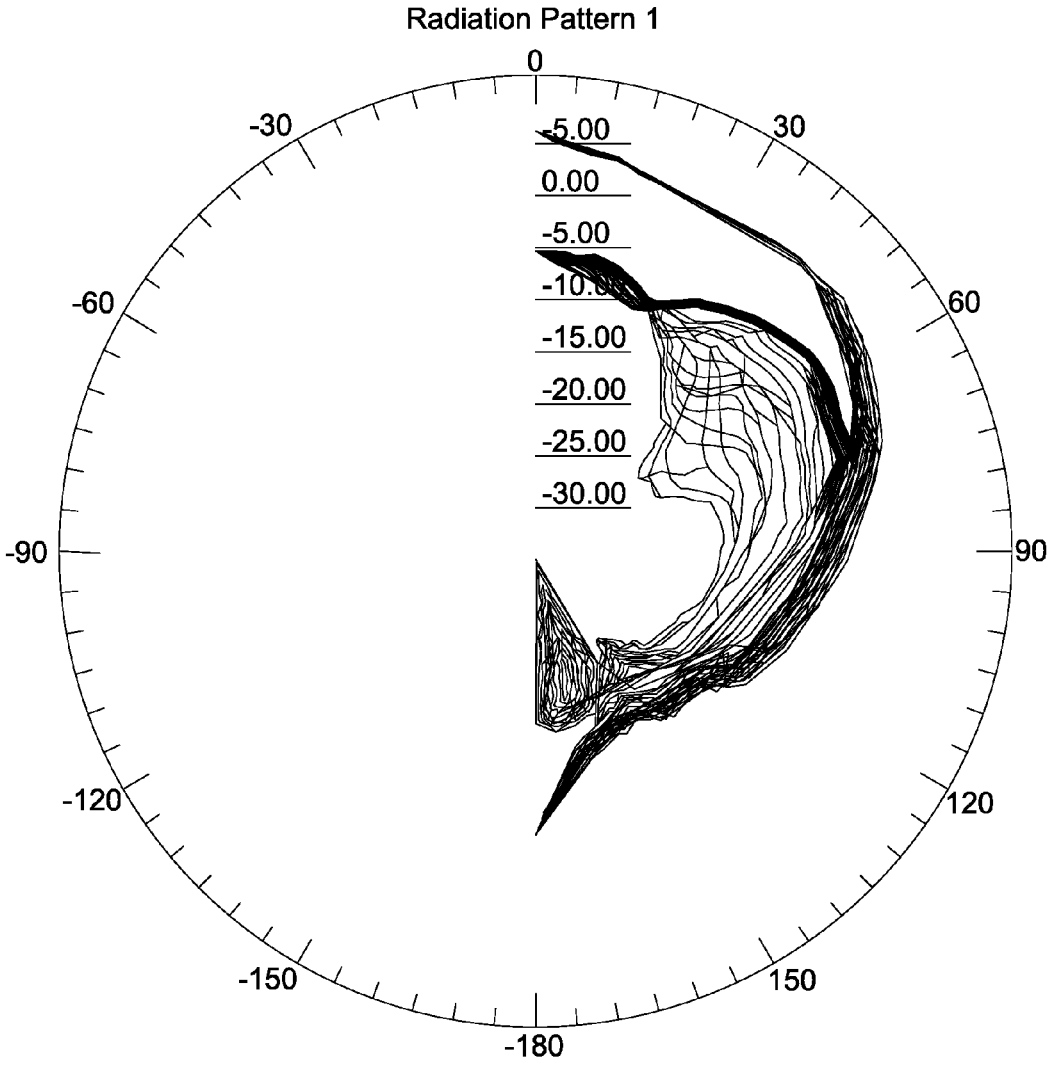
Figure 8:
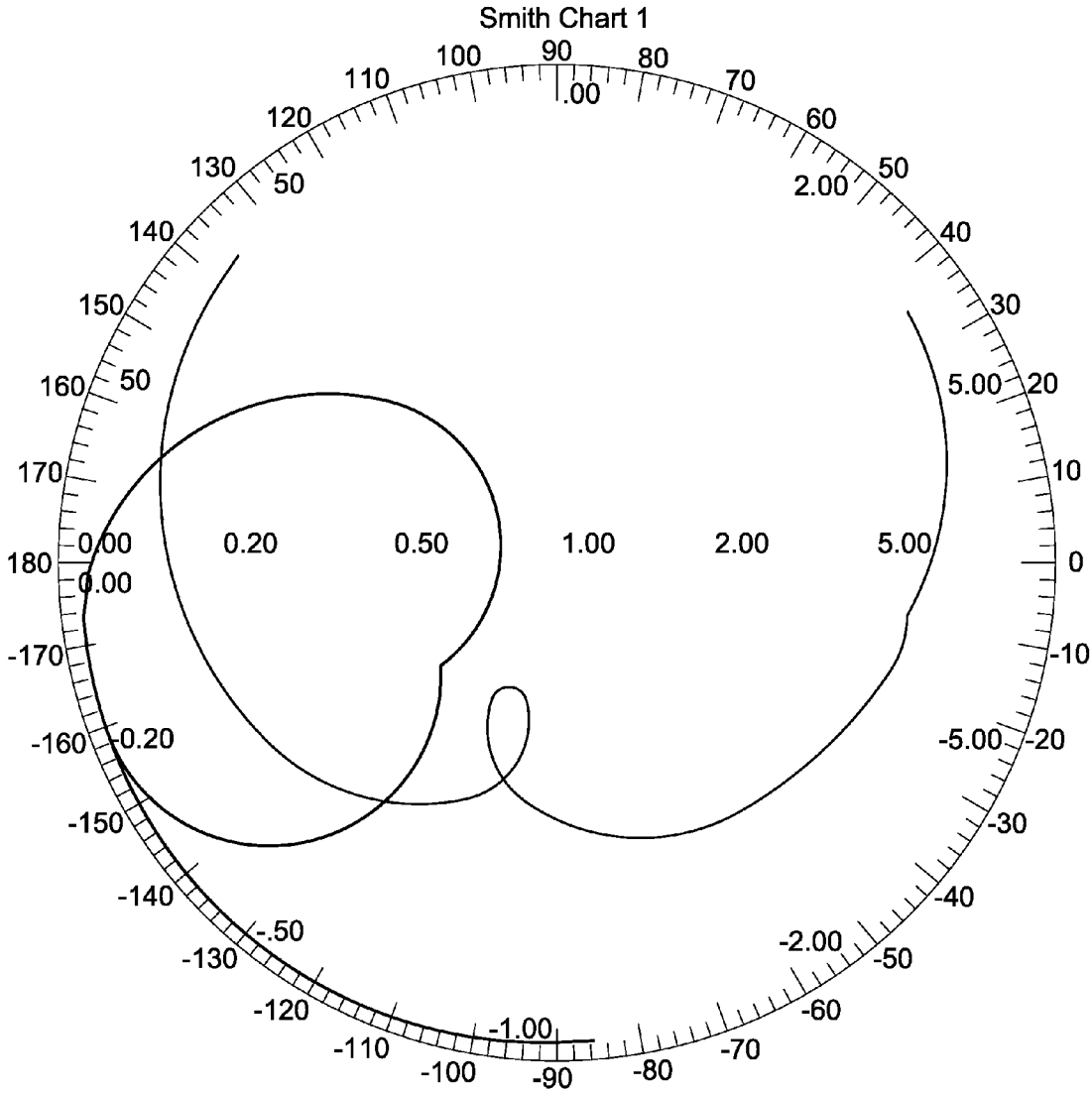

FIGS. 6-8 are plots illustrating the performance of the current antenna.

FIG. 6 is a radiation pattern for the current antenna showing that the SDARS LHCP zenith gain is 5 dB and that its cross-polarized (RHCP) gain is −8 dB.

FIG. 7 is a radiation pattern for the current antenna showing that the GPS RHCP zenith gain is 4 dB and that its cross-polarized (LHCP) gain is −7 dB.

FIG. 8 is a Smith chart showing the impedance of the coplanar patches.

The above descriptions are those of the current embodiments of the invention. Various alterations and changes can be made without departing from the spirit and broader aspects of the invention as defined in the appended claims, which are to be interpreted in accordance with the principles of patent law including the doctrine of equivalents.

The invention claimed is:

1. An antenna comprising:

a first substantially planar, substantially square antenna element having at least one non-square corner;

a second substantially planar, substantially square antenna element having at least one non-square corner, the second antenna element surrounding the first antenna element and defining a gap therebetween, the first and second antenna elements being substantially coplanar and substantially concentric;

four inductors each interconnecting one side of the first antenna element and one side of the second antenna element; and a feed connected to the first antenna element, whereby the first antenna element resonates at a first frequency with a first circular polarization sense, and further whereby the first and second antenna elements together resonate at a second frequency with a second circular polarization sense.

2. An antenna as defined in claim 1 wherein the circuit comprises a parallel resonant inductive circuit.

3. An antenna as defined in claim 1 wherein each inductor and the gap function as an LC circuit.

4. An antenna as defined in claim 3 wherein:

each inductor comprises a trace within the gap; and the gap and each of the traces function as an LC circuit.

5. An antenna as defined in claim 4 wherein the gap is of substantially uniform width around the entire circumference of the first antenna element.

6. An antenna as defined in claim 1 wherein:

the first antenna element including four corners, two of the corners diagonally opposite one another being square; and the second antenna element having an inner edge and an outer edge each being substantially square and having four corners, two of the corners on each of the inner and outer edges diagonally opposite one another being non-square, the two corners of the inner edge being adjacent the two corners of the first antenna element, the two corners of the outer edge being remote from the two corners of the first antenna.

7. An antenna comprising:

a first substantially planar antenna element, the first antenna element being substantially square and having four corners, two of the corners diagonally opposite one another being substantially square; and a second substantially planar antenna element surrounding the first antenna element and defining a gap therebetween, the first and second antenna elements being substantially coplanar, the second antenna element including an inner edge and an outer edge each being substantially square and having four corners, the inner and outer edges being substantially concentric, two of the corners on each of the inner and outer edges diagonally opposite one another being non-square, the two corners of the inner edge being adjacent the two corners of the first antenna element, the two corners of the outer edge being remote from the two corners of the first antenna;

a plurality of inductors each interconnecting the first and second antenna elements; and a feed connected to only one of the first and second antenna elements.

8. An antenna comprising:

a first substantially planar antenna element being substantially square and having four corners, two of the corners diagonally opposite one another being square; and a second substantially planar antenna element substantially coplanar with and surrounding the first antenna element, the second antenna element having an inner edge and an outer edge each being substantially square and having four corners, the inner and outer edges being substantially concentric, two of the corners on each of the inner and outer edges diagonally opposite one another being non-square, the two corners of the inner edge being adjacent the two corners of the first antenna element, the two corners of the outer edge being remote from the two corners of the first antenna, the first and second elements defining a gap surround the first antenna element.

9. An antenna as defined in claim 8 wherein the gap is of substantially uniform width about the circumference of the first antenna element.

* * * * *